US005974277A

United States Patent [19]

Yamane et al.

[11] Patent Number: 5,974,277

[45] Date of Patent: Oct. 26, 1999

[54] ELECTROPHOTOGRAPHIC PRINTING APPARATUS WITH TWO CHARGING BODIES

[75] Inventors: Tsutomu Yamane; Kuniharu Hayashi, both of Tokyo, Japan

[73] Assignee: Oki Data Corporation, Tokyo, Japan

[21] Appl. No.: 09/150,880

[22] Filed: Sep. 10, 1998

[30] Foreign Application Priority Data

Sep. 19, 1997 [JP] Japan ..... 9-273880

[51] Int. Cl.[6] ..... G03G 15/02

[52] U.S. Cl. ..... 399/50; 361/225; 399/174

[58] Field of Search ..... 399/50, 99, 100, 399/148, 168, 174, 176; 361/221, 225

[56] References Cited

U.S. PATENT DOCUMENTS 5,124,757 6/1992 Ikegawa ..... 399/148
5,765,076 6/1998 Ogata et al. ..... 399/168
5,768,653 6/1998 Faré ..... 399/50

FOREIGN PATENT DOCUMENTS 6-222649 8/1994 Japan .
7-049601 2/1995 Japan .
7-140762 6/1995 Japan .

*Primary Examiner*—Arthur T. Grimley
*Assistant Examiner*—Sophia S. Chen
*Attorney, Agent, or Firm*—Akin, Gump, Strauss, Hauer & Feld, L.L.P.

[57] ABSTRACT

An electrophotographic printing apparatus has two charging bodies that are held at different potentials. The first charging body makes contact with the surface of a photosensitive drum; the second charging body makes contact with the first charging body. Toner particles that have acquired an electrostatic charge opposite to their normal charge are attracted from the drum surface to the first charging body. These toner particles are then attracted from the first charging body to the second charging body, whereby the first charging body is kept clean and able to charge the surface of the photosensitive drum to a uniform potential.

11 Claims, 4 Drawing Sheets

FIG. 4
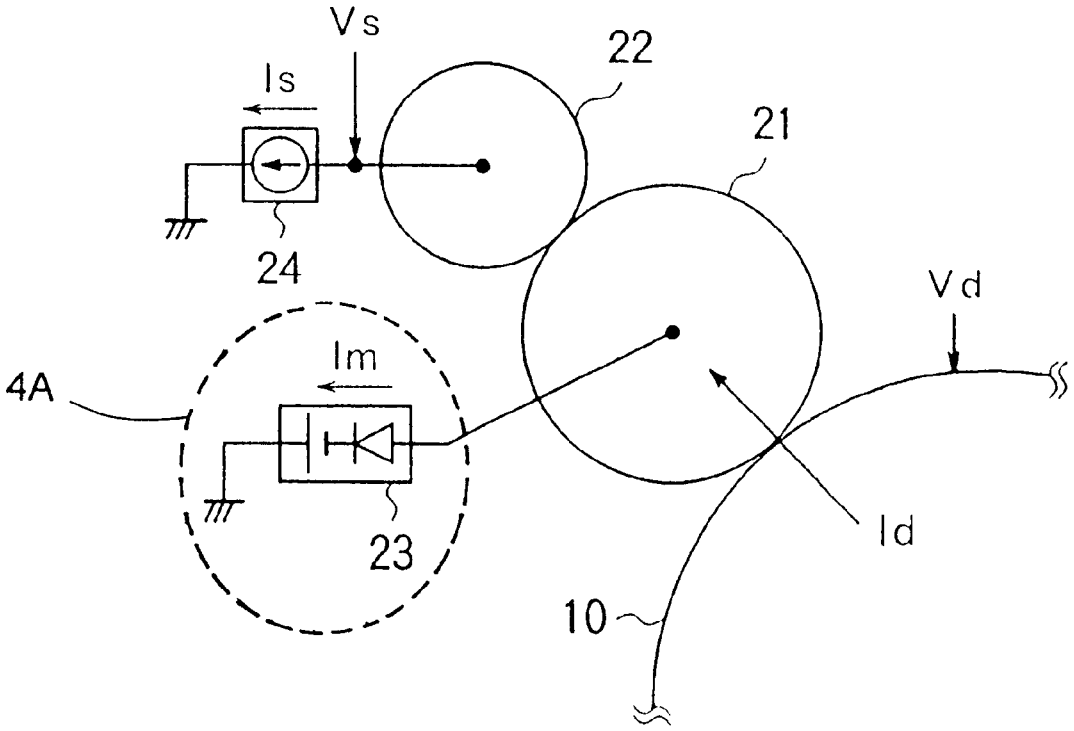
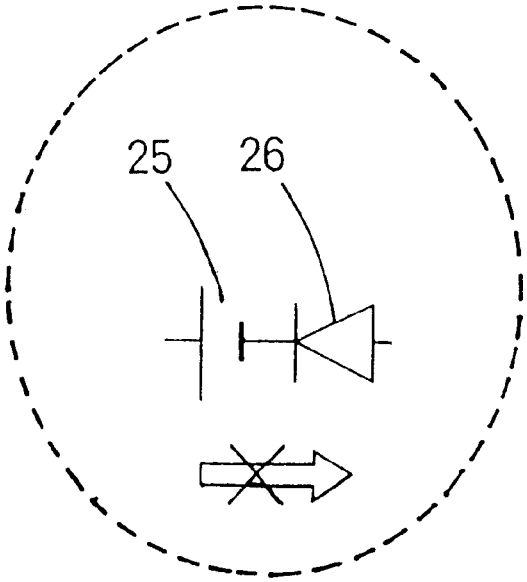
FIG. 4A

ELECTROPHOTOGRAPHIC PRINTING APPARATUS WITH TWO CHARGING BODIES

BACKGROUND OF THE INVENTION

The present invention relates to an electrophotographic printing apparatus, more particularly an improvement in the charging unit of an electrophotographic printing apparatus.

Electrophotographic printing apparatus can be found in facsimile machines, copiers, and, of course, printers. The charging unit charges a photosensitive drum, which is then exposed to light to form a latent electrostatic image. The image is developed by application of charged toner particles. The resulting toner image is transferred to paper or other printing media by an oppositely charged transfer unit. Toner that fails to be transferred is removed from the surface of the drum by a cleaning unit.

The charging unit of a conventional electrophotographic printing apparatus comprises a charging body such as a roller that turns in contact with the photosensitive drum, and a constant-voltage source that holds the charging body at a fixed potential. The potential difference between the charging body and the photosensitive drum, which is grounded, causes charge to be deposited from the charging body onto the surface of the photosensitive drum.

A problem in the conventional electrophotographic printing apparatus is that during the developing and transfer processes, a small amount of toner acquires a charge opposite to the normal toner charge. This oppositely charged toner is neither transferred to the printing media nor removed by the cleaning unit, but is attracted to the charging body by the potential difference between the charging body and photosensitive drum. Accumulation of such toner on the charging body increases the electrical resistance between the charging body and the surface of the photosensitive drum, thus reducing the amount of charge deposited on the drum surface during the charging process. The result of this inadequate charging is that toner adheres to unwanted portions of the photosensitive drum, causing printing defects such as fogging.

SUMMARY OF THE INVENTION

An object of the present invention is to prevent the accumulation of toner in the charging unit of an electrophotographic printing apparatus.

An associated object is to obtain uniform printing quality.

A further object is to conserve toner by returning toner from the charging unit to the developing unit of an electrophotographic printing apparatus.

The invented electrophotographic printing apparatus has a photosensitive drum, a charging unit, an optical exposure unit, a developing unit that applies toner particles having a first electrostatic charge to the photosensitive drum, and a transfer unit that transfers the resulting toner image to printing media. The charging unit comprises a first charging body making contact with the photosensitive drum, and a second charging body making contact with the first charging body.

The first charging body is placed at an electrical potential that attracts toner particles having a second electrostatic charge, opposite to the first electrostatic charge, from the photosensitive drum to the first charging body. The second charging body is placed at an electrical potential that attracts toner particles having the second electrostatic charge from the first charging body to the second charging body.

The charging unit feeds current through the charging bodies to the surface of the photosensitive drum, preferably feeding a first current from a voltage source through the first charging body, and a second current from a current source through the second and first charging bodies. The voltage source holds the first charging body at a constant potential, while the current source controls the potential of the second charging body so as to keep the second current, or the sum of the first and second currents, at a substantially constant level. The second current is preferably smaller than the first current. The voltage source preferably has a circuit element that prevents diversion of the second current into the voltage source.

The first and second charging bodies are preferably rollers turning at different speeds, generating friction that transfers a third electrostatic charge, opposite to the second electrostatic charge, to the toner particles attracted to the second charging body.

By removing toner from the first charging body, the second charging body prevents accumulation of toner on the first charging body and enables the first charging body to charge the photosensitive drum to a uniform potential, leading to uniform printing quality.

Toner particles acquiring the third electrostatic charge are attracted from the second charging body back to the first charging body, then back to the photosensitive drum, and can be recovered in the developing unit, thereby conserving toner and preventing the accumulation of toner particles in the charging unit as a whole.

BRIEF DESCRIPTION OF THE DRAWINGS

In the attached drawings:

FIG. 4 indicates voltages and currents in the charging unit, and illustrates the internal structure of the voltage source.

DETAILED DESCRIPTION OF THE INVENTION

An electrophotographic printing apparatus embodying the invention will be described with reference to the attached illustrative drawings.

Figure 1:
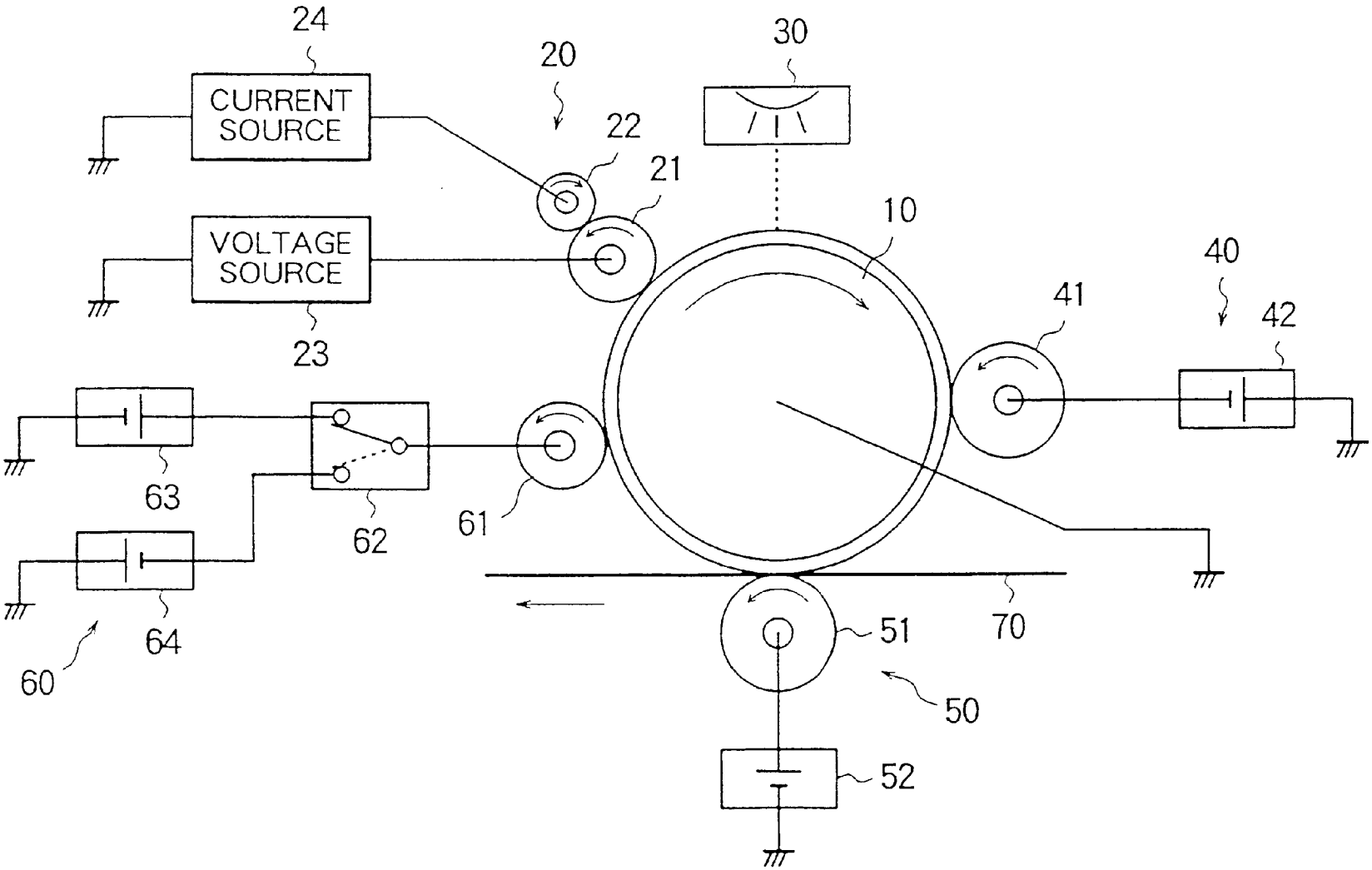
FIG. 1 is a sectional schematic view of an electrophotographic printing apparatus embodying the present invention.

With reference to FIG. 1, this printing apparatus comprises a photosensitive drum 10, a charging unit 20, an optical exposure unit 30, a developing unit 40, a transfer unit 50, and a cleaning unit 60.

The photosensitive drum 10 comprises, for example, an electrically grounded aluminum cylinder coated with an organic photoconductive material of a type that readily acquires a negative electrostatic charge.

The charging unit 20 comprises a semi-conductive rubber first charging roller 21, a conductive metallic second charging roller 22, a voltage source 23, and a current source 24. The second charging roller 22 makes contact with the first charging roller 21, which makes contact with the surface of the photosensitive drum 10. The voltage source 23 holds the first charging roller 21 at a predetermined negative potential, such as minus one thousand three hundred fifty volts (−1350 V), with respect to ground, and feeds current through the first charging roller 21 to the surface of the photosensitive drum 10. The current source 24 applies a still more negative potential to the second charging roller 22, such as a potential in the range from −1700 V to −1900 V, and feeds a substantially constant current through the second charging roller 22 and first charging roller 21 to the surface of the photosensitive drum 10.

The optical exposure unit 30 illuminates selected areas on the surface of the photosensitive drum 10.

The developing unit 40 comprises a semi-conductive rubber developing roller 41 and a developing power supply 42. The developing roller 41 carries toner particles, supplied from a reservoir not shown in the drawing, to the surface of the photosensitive drum 10. The developing power supply 42 holds the developing roller 41 at a predetermined negative potential.

The transfer unit 50 comprises a transfer roller 51, and a transfer power supply 52 that holds the transfer roller 51 at a predetermined positive potential.

The cleaning unit 60 comprises a cleaning roller 61, a single-pole double-throw switch 62, a positive direct-current power supply 63, and a negative direct-current power supply 64. The switch 62 connects a selected one of the two power supplies 63 and 64 to the cleaning roller 61, which turns in contact with the photosensitive drum 10.

During printing, the switch 62 selects the positive power supply 63, and the photosensitive drum 10 and rollers 21, 22, 41, 51, and 61 are turned by a motor and gears (not visible) in the directions indicated by arrows in the drawing. At the point of contact between the photosensitive drum 10 and first charging roller 21, current flowing from the voltage source 23 and current source 24 through the first charging roller 21 and second charging roller 22 deposits negative charge on the surface of the photosensitive drum 10. The surface of the photosensitive drum 10 thus acquires a negative potential of, for example, substantially −800 V. When the photosensitive drum 10 is illuminated by the optical exposure unit 30, negative charge escapes from the illuminated surface portions into the grounded interior of the photosensitive drum 10.

The toner particles brought by the developing roller 41 into contact with the photosensitive drum 10 have a negative charge, acquired from friction within the developing unit 40. The negative potential of the developing roller 41 is intermediate between the negative potential of the non-illuminated portions of the drum surface and the substantially ground potential of the illuminated portions. The negatively charged toner particles are therefore attracted to the illuminated portions, and repelled from the non-illuminated portions. In this way a toner image is formed on the surface of the photosensitive drum 10.

Paper 70 or other printing media is fed between the photosensitive drum 10 and the transfer roller 51. The positive potential of the transfer roller 51 attracts the negatively charged toner particles from the photosensitive drum 10 to the paper 70, transferring the toner image to the paper 70. The toner image is then fused onto the paper by heat and pressure in a fusing unit (not visible).

Not all of the negatively charged toner is transferred to the paper 70; a small amount of toner is carried past the transfer unit 50 while continuing to adhere to the photosensitive drum 10. Some of this remaining toner moreover acquires a positive charge by current flow from the transfer roller 51 through the paper 70. In addition, a few toner particles may receive a positive charge in the developing unit 40, and these toner particles also pass the transfer unit 50 without being attracted to the paper 70.

In the cleaning unit 60, the cleaning roller 61, which is held at a positive potential by the positive direct-current power supply 63, removes the remaining negatively-charged toner from the surface of the photosensitive drum 10. Positively charged toner particles, however, pass through the cleaning unit 60 without being attracted to the cleaning roller 61, and reach the charging unit 20.

Figure 2:
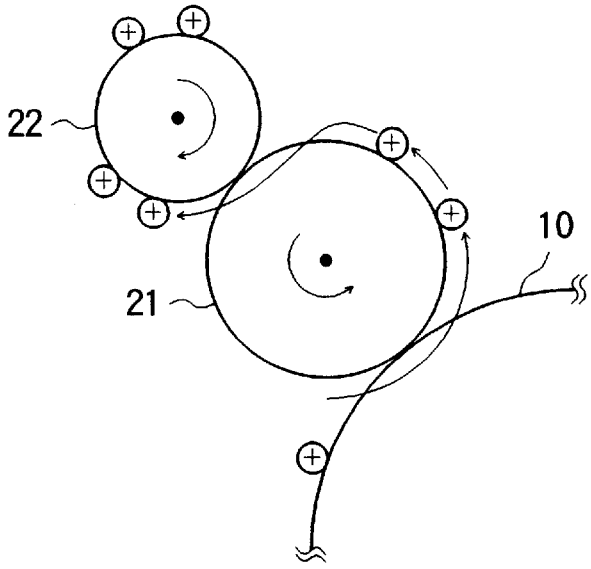
FIG. 2 illustrates the movement of toner particles having the second electrostatic charge in the charging unit.

Referring to FIG. 2, these positively charged toner particles are attracted from the photosensitive drum 10 to the first charging roller 21, which is at a more negative potential than the surface of the photosensitive drum 10. As the first charging roller 21 turns, the positively charged toner particles are carried to the point of contact with the second charging roller 22, which is at a still more negative potential, and are attracted to the second charging roller 22. Thus toner does not accumulate on the surface of the first charging roller 21, which remains substantially clean. The electrical resistance between the first charging roller 21 and photosensitive drum 10 therefore remains substantially constant, enabling the first charging roller 21 to charge the surface of the photosensitive drum 10 to a uniform potential.

Figure 3:
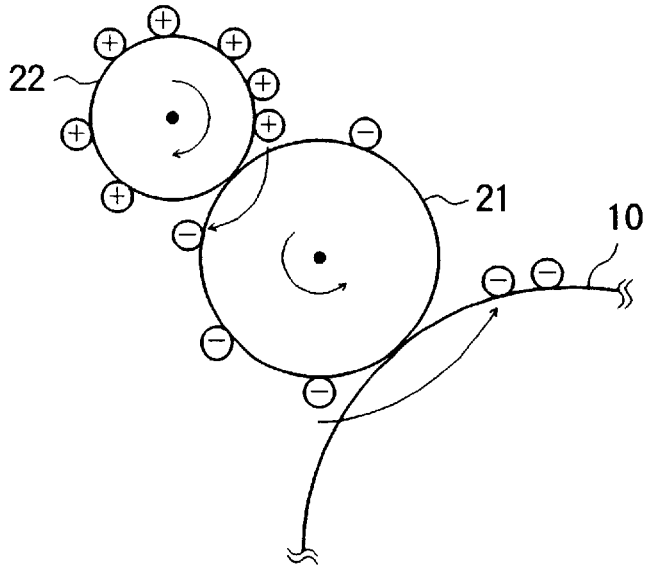
FIG. 3 illustrates the movement of toner particles having the third electrostatic charge in the charging unit.

Referring to FIG. 3, the positively charged toner particles are carried around the second charging roller 22 and return to the point of contact with the first charging roller 21. The first charging roller 21 and second charging roller 22 are driven at different speeds, so that at this point, the surface of the second charging roller 22 moves about twenty percent slower, for example, than the surface of the first charging roller 21. The resulting friction between the charging roller surfaces and toner particles, combined with the negative potentials of the first charging roller 21 and second charging roller 22, imparts a negative charge to at least some of the toner particles. These now negatively-charged toner particles are attracted from the second charging roller 22 to the first charging roller 21, which is at a relatively higher potential; are carried by the first charging roller 21 to the point of contact with the surface of the photosensitive drum 10, which is at a still higher potential; and are there attracted from the first charging roller 21 to the photosensitive drum 10. If disposed in areas that are not illuminated by the optical exposure unit 30, these toner particles will be subsequently attracted to the developing roller 41 in the developing unit 40. If disposed in illuminated areas, these toner particles will be transferred to paper 70 by the transfer unit 50.

Positively charged toner particles that enter the charging unit 20 accordingly accumulate on neither the first charging roller 21 nor the second charging roller 22, but are gradually returned, with a negative charge, to the photosensitive drum 10 and developing unit 40, for further use in printing.

Referring to FIG. 4, the voltage source 23 comprises a constant-voltage direct-current power supply 25 and a diode 26. The diode 26 prevents flow of current between the power supply 25 and the current source 24, which is at a more negative potential than the output potential of the power supply 25. Diode 26 assures that all of the current Is output by the current source 24 flows through the second charging roller 22 and first charging roller 21 to the surface of the photosensitive drum 10, and that none of this current Is is diverted into the voltage source 23. The total current Id that charges the surface of the photosensitive drum 10 is accordingly equal to the sum of the current Im output by the voltage source 23 and the current Is output by the current source 24.

To charge the surface of the photosensitive drum 10 to a uniform potential Vd, a constant total charging current Id must be maintained, regardless of the electrical resistance between the first charging roller 21 and the photosensitive drum 10. Ideally, the surface of the first charging roller 21 is kept perfectly clean, the electrical resistance between the first charging roller 21 and the photosensitive drum 10 does not vary, and the current Im output by the voltage source 23 remains constant. In this ideal case, it suffices for the second charging roller 22 to output a constant current Is, despite possible variations in the surface resistance of the second charging roller 22 due to varying amounts of toner on the second charging roller 22. The current source 24 can maintain a constant current output by suitably varying the potential Vs applied by the second charging roller 22.

In practice, the resistance between the first charging roller 21 and photosensitive drum 10 varies slightly as toner is transferred between the first charging roller 21 and photosensitive drum 10 at varying rates. The current output Im by the voltage source 23 may therefore vary somewhat, in which case it is desirable for the current Is output by the current source 24 to vary in a compensatory manner, maintaining a constant sum Im+Is. This type of compensation can be achieved by, for example, sensing the Im current value in the voltage source 23 and controlling the potential Vs applied by the current source 24 to the second charging roller 22 according to the Im value.

Figure 5:
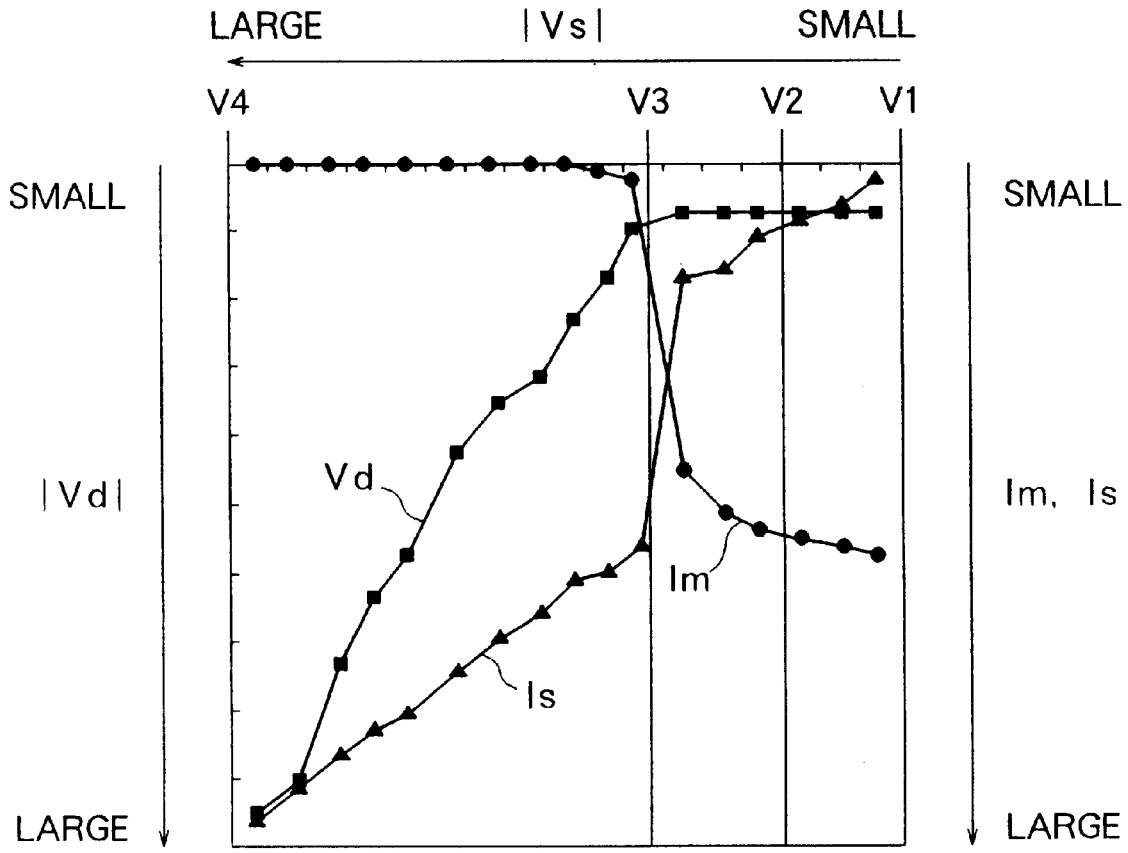
FIG. 5 is a graph illustrating the voltages and currents indicated in FIG. 4.

FIG. 5 illustrates the operation of this control scheme by plotting the currents Im and Is output by the voltage source 23 and current source 24, and the resulting drum surface potential Vd, as a function of the absolute value of the potential Vs applied to the second charging roller 22. This absolute value |Vs| is shown on the horizontal axis, while Im, Is, and |Vd| are shown on the vertical axes. V1, V2, V3, and V4 represent increasingly large negative potentials. In the range from V1 to V3, the drum surface potential Vd remains substantially constant despite variations in Im. In the range from V3 to V4, Im becomes substantially equal to zero, and a uniform drum surface potential Vd is not obtained.

FIG. 5 indicates that a uniform drum surface potential Vd is best maintained when Is is less than Im. Experiments performed by the inventors also indicate that satisfactory transfer of positively charged toner from the first charging roller 21 to the second charging roller 22 requires a certain minimum current flow between the first charging roller 21 and second charging roller 22. Thus Is should be at least, for example, about five microamperes (5 $\mu$A), and the current source 24 should be designed to operate at voltages Vs in the general vicinity of V2, avoiding both voltages close to V1 and voltages close to V3.

The power supplies 23, 24, 42, 52, 63, and 64 shown in the drawings need not all be separate units, but may be combined in various ways. The voltages output by the voltage source 23 and current source 24 are not limited to the values and ranges mentioned above. In addition, the polarities of all of the power supplies may also be reversed, positively charged toner then being used to develop the latent electrostatic image on the photosensitive drum 10.

The first charging roller 21 may be replaced by any type of charging body making contact with the photosensitive drum 10. The second charging roller 22 may be replaced by any type of charging body making contact with the first charging body.

Those skilled in the art will recognize that further variations are possible within the scope claimed below.

What is claimed is:

1. An electrophotographic printing apparatus having a photosensitive drum, a charging unit charging the photosensitive drum to a uniform surface potential, an optical exposure unit forming a latent image on the photosensitive drum, a developing unit converting the latent image to a toner image by application of toner particles having a first electrostatic charge, and a transfer unit transferring the toner image to a printing medium, the charging unit comprising:

a first charging body making contact with said photosensitive drum, said first charging body having a first electrical potential attracting toner particles having a second electrostatic charge, opposite to said first electrostatic charge, from said photosensitive drum to said first charging body;

a second charging body making contact with said first charging body, said second charging body having a second electrical potential attracting said toner particles having said second electrostatic charge from said first charging body to said second charging body;

a voltage source causing a first current to flow between said first charging body and a surface of said photosensitive drum, maintaining said first electrical potential at a predetermined level; and a current source causing a second current to flow between said second charging body and the surface of said photosensitive drum on a path through said first charging body, maintaining said second current at a substantially constant level by controlling said second electrical potential.

2. The electrophotographic printing apparatus of claim 1, wherein said voltage source comprises a circuit element preventing diversion of said second current through said first charging body to said voltage source.

3. The electrophotographic printing apparatus of claim 1, wherein said second current is smaller than said first current.

4. An electrophotographic printing apparatus having a photosensitive drum, a charging unit charging the photosensitive drum to a uniform surface potential, an optical exposure unit forming a latent image on the photosensitive drum, a developing unit converting the latent image to a toner image by application of toner particles having a first electrostatic charge, and a transfer unit transferring the toner image to a printing medium, the charging unit comprising:

a first charging body making contact with said photosensitive drum, said first charging body having a first electrical potential attracting toner particles having a second electrostatic charge, opposite to said first electrostatic charge, from said photosensitive drum to said first charging body;

a second charging body making contact with said first charging body, said second charging body having a second electrical potential attracting said toner particles having said second electrostatic charge from said first charging body to said second charging body;

a voltage source causing a first current to flow in said first charging body, maintaining said first electrical potential at a predetermined level; and a current source causing a second current to flow in said second charging body, maintaining a sum of said first current and said second current at a substantially constant level by controlling said second electrical potential, thereby causing said photosensitive drum to be charged to a uniform electrical potential by said first current and said second current.

5. The electrophotographic printing apparatus of claim 4, wherein said voltage source comprises a circuit element preventing diversion of said second current through said first charging body to said voltage source.

6. The electrophotographic printing apparatus of claim 4, wherein said current source controls said second electrical potential so that said second current is smaller than said first current.

7. A method of charging a photosensitive drum in an electrophotographic printing apparatus in which toner particles having a first electrostatic charge are employed to develop a latent image on the photosensitive drum, comprising the steps of:

applying a first potential from a voltage source to a first charging body making contact with a surface of said photosensitive drum, causing a first current to flow between said first charging body and the surface of said photosensitive drum, said first potential attracting toner particles having a second electrostatic charge opposite to said first electrostatic charge from the surface of said photosensitive drum to said first charging body; and applying a second potential to a second charging body making contact with said first charging body, causing a second current to flow between said second charging body and the surface of said photosensitive drum on a path through said first charging body said second potential attracting toner particles having said second electrostatic charge from said first charging body to said second charging body; wherein said first current is supplied from said voltage source to said first charging body through a circuit element preventing diversion of said second current to said voltage source.

8. The method of claim 7, wherein said second potential is applied from a current source.

9. The method of claim 8, further comprising the step of holding said second current at a predetermined level.

10. The method of claim 8, further comprising the step of holding a sum of said first current and said second current at a predetermined level.

11. The method of claim 8 wherein said second current is smaller than said first current.

* * * * *